US005588880A

United States Patent [19]

Wood

[11] Patent Number: 5,588,880

[45] Date of Patent: Dec. 31, 1996

[54] TERMINAL BLOCK

[75] Inventor: Daniel P. Wood, Laurel Hill, N.C.

[73] Assignee: Acme Electric Corporation, East Aurora, N.Y.

[21] Appl. No.: 401,722

[22] Filed: Mar. 10, 1995

[51] Int. Cl.[6] ..... H01R 9/22

[52] U.S. Cl. ..... 439/709; 439/716

[58] Field of Search ..... 439/709, 715, 439/716, 801, 810, 797

[56] References Cited

U.S. PATENT DOCUMENTS

| | | | |
|---|---|---|---|
| 3,246,283 | 4/1966 | Huska | 439/716 |
| 3,496,521 | 2/1970 | Hohorst | 439/716 |
| 3,510,830 | 5/1970 | Wieland . | |
| 3,657,684 | 4/1972 | Rauter et al. . | |
| 3,691,425 | 9/1972 | Weyrich et al. . | |
| 3,992,074 | 11/1976 | Rymer | 439/716 |
| 4,004,846 | 1/1977 | Woertz | 439/716 |
| 4,602,235 | 7/1986 | Howard et al. . | |
| 4,804,340 | 2/1989 | Hamer et al. . | |
| 5,090,922 | 2/1992 | Rymer et al. | 439/716 |
| 5,200,731 | 4/1993 | Tochio et al. . | |
| 5,267,393 | 12/1993 | Purohit et al. . | |
| 5,427,550 | 6/1995 | Jaag | 439/709 |

*Primary Examiner*—Gary F. Paumen
*Assistant Examiner*—Yong Kim
*Attorney, Agent, or Firm*—Pearne, Gordon, McCoy & Granger

[57] ABSTRACT

A finger-safe terminal block has an insulator base with two separate rotatable screws in screw apertures leading to first and second clamp areas. First and second conductor apertures also lead to these clamp areas. A tool access end accessible from the exterior of the base is provided on each screw so that tightening of each screw is adapted to physically clamp an end of an external conductor in the respective clamp area. The screw apertures and the conductor apertures at the exterior surface of the base are smaller than an adult human's fingertip so that such fingertip cannot touch any electrically energizable conductor in the terminal block. The foregoing Abstract is merely a resume of general applications, it is not a complete discussion of all principles of operation or applications, and is not to be construed as a limitation on the scope of the claimed subject matter.

12 Claims, 1 Drawing Sheet

TERMINAL BLOCK

BACKGROUND OF THE INVENTION

A number of terminals have been known in the prior art including screw terminals to attach to internal and external conductors. Many of these terminal blocks have barriers between screw terminals, but still, the screw terminal itself is exposed and may be easily be touched by an adult human's fingertip. Other known terminal blocks have one screw terminal and one solder terminal, with at least the solder terminal exposed and presenting a shock hazard.

The U.S. Pat. No. 3,691,425 discloses a transformer coil with terminals which have exposed electrical conductive parts of the terminal and of wires connected to such terminal. U.S. Pat. No. 5,267,393 also has low voltage terminals 36 which are exposed. Such terminals in both patents are not finger safe, instead they have exposed metallic components.

U.S. Pat. No. 5,200,731 discloses terminal blocks on a transformer for solder connections. The terminals may be covered by an insulating case. However, this case may be lost by the consumer. U.S. Pat. No. 4,804,340 discloses a molded plastic terminal block with exposed soldered screw connections. U.S. Pat. No. 4,602,235 discloses a transformer with exposed soldered terminals. U.S. Pat. No. 3,657,684 discloses a recessed clamping area but does not disclose any means to protect the clamping screw from exposure. U.S. Pat. No. 3,510,830 discloses an electrical connector having a plastic body and two mechanical fasteners with both screws engaging and moving a single metal connector body.

SUMMARY OF THE INVENTION

An object of the present invention is to provide a terminal block which may provide interconnection between two external conductors, yet, an adult human's fingertip cannot touch an energizable, electrical conductor. Another object of the invention is to provide a terminal block which has conductor apertures and tightening screw apertures which are sufficiently small and recessed from the exterior surface so that an adult human's fingertip cannot touch any energizable, electrical conductors. Another object of the invention is to provide a terminal block which may be easily and quickly snapped into place on a mount to fix the terminal block in place.

A finger-safe terminal block including, an insulator base, first and second screw apertures in the exterior surface of said insulator base, first and second rotatable screws in said first and second screw apertures, respectively, leading to first and second clamp areas, respectively, of said insulator base, first and second conductor apertures in said insulator base adapted to receive first and second external conductors therein, respectively, said first and second conductor apertures leading from the exterior surface to said first and second clamp areas, respectively, of said base, each screw having a tool access end accessible from the exterior surface of the base, wherein tightening of each screw is adapted to physically clamp an end of an external conductor in the respective clamp area, said first and second screw apertures at the base exterior surface being sufficiently small and each screw being mounted in a respective screw aperture with the tool access end recessed from the base exterior surface sufficiently that it cannot be touched by an adult human's finger tip, and a conductor in said insulator base to provide electrical connection between said first and second clamp areas at least when the screws are tightened.

Other objects and a fuller understanding of the invention may be had by referring to the following description and claims, taken in conjunction with the accompanying drawing.

DESCRIPTION OF THE PREFERRED EMBODIMENTS

Figures 1, 2, 3, 4, 5:
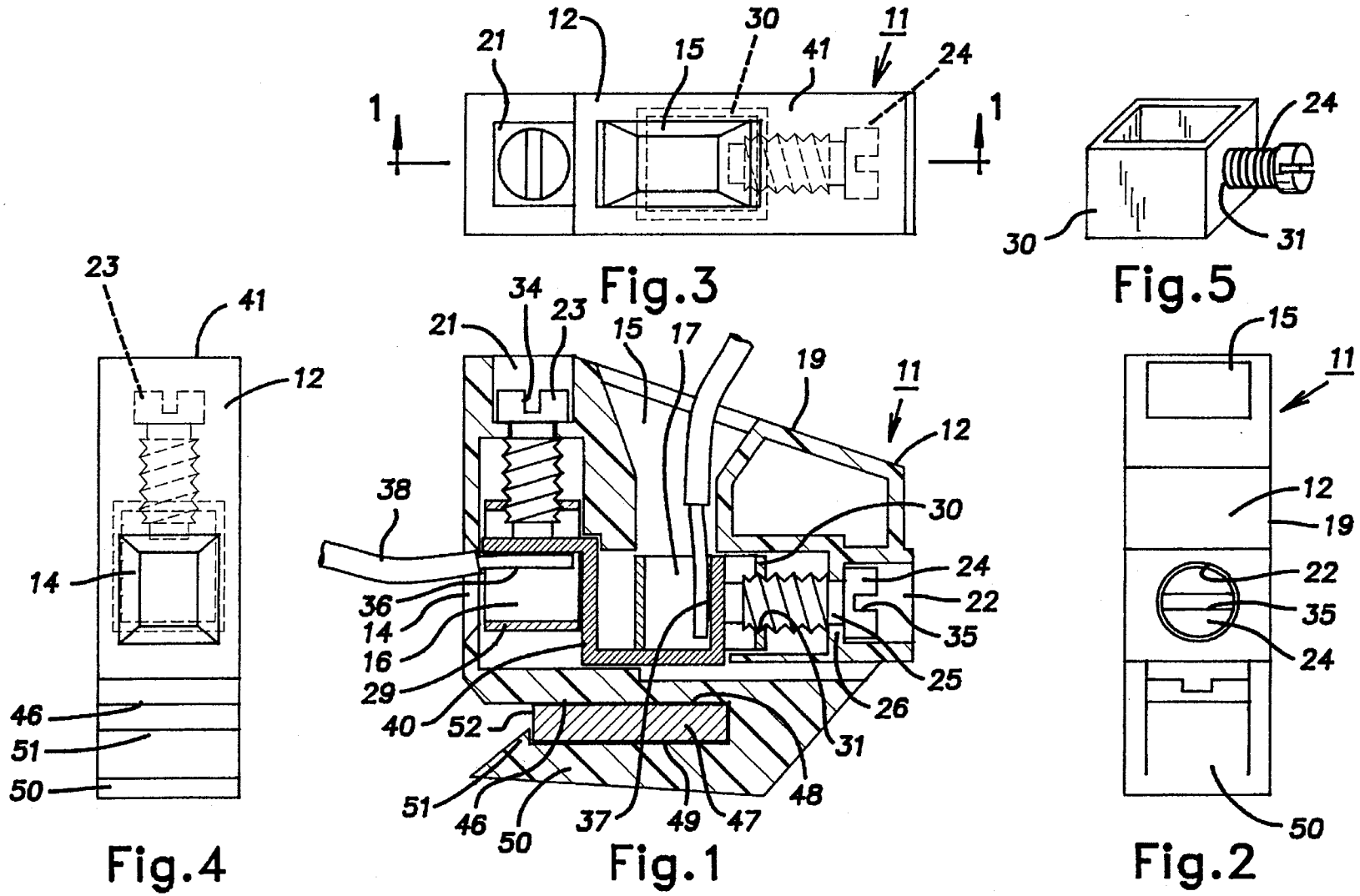
FIG. 1 is a longitudinal sectional view of a terminal block embodying the invention.
FIG. 2 is a right-side elevation of the terminal block.
FIG. 3 is a plan view of the terminal block.
FIG. 4 is a left-side elevation of the terminal block.
FIG. 5 is an isometric view of a metal cage in the terminal block.

The FIGS. 1 to 4 illustrate a terminal block 11 constructed in accordance with the invention. This terminal block has a base 12, and in this case it is made of insulation, such as ceramic or a hardened, plastic material. First and second conductor apertures 14 and 15, respectively, lead to first and second clamp areas 16 and 17, respectively, which are positioned inside the exterior surface 19 of the base 12. First and second screw apertures 21 and 22 lead from the exterior surface 19 into the first and second clamp areas, respectively. First and second screws 23 and 24, respectively, are positioned in each of the screw apertures, respectively, and each screw has an annular recess 25 which is axially secured in a annular shoulder 26 of the base. This makes the screw a captive screw so that it is rotatable but not axially movable. Each screw is adapted to secure a conductor in the respective clamp areas. To this end, the first and second screws 23 and 24 threadably engage first and second cages 29 and 30, respectively, in a tapped aperture. FIG. 5 shows an isometric view of the second cage 30 with the second screw 24 threaded into the tapped aperture 31. Each screw has a tool access end 34 and 35, respectively, so that a tool, such as a screw driver, may be inserted from the exterior surface of the base to the screw to be able to rotate the screw. The rotation of each screw moves axially the respective cage 29 and 30, and the tightening of this screw moves a wall of the respective cage toward first and second external conductors 36 and 37, respectively, so as to the clamp the exposed end of such conductor to the clamp area. Each of these conductors would be suitably insulated with insulation 38 and 39, respectively. The insulation 38 on the first conductor would typically be enamel, and this first conductor may be considered as one leading from an electrical device, for example a transformer coil adjacent the terminal block 11. Thus, this connection to the conductor 36 would be made at the factory by tightening the first screw 23. This pulls the cage 29 to clamp the conductor 36 between the cage 29 and a wall of the clamp area. In this case, this wall is a metal clamp bar 40 which provides an electrical conductor between the first and second clamp areas 16 and 17, respectively.

In the preferred construction of this terminal block, the first and second screw apertures 21 and 22 at the base exterior surface 19 is smaller than an adult human's fingertip, and each screw is mounted in a respective screw aperture with a tool access end 34 and 35 recessed inwardly from the base exterior surface sufficiently that the screw cannot be touched by an adult human's fingertip. The clamp bar 40 is an electrical conductor within the insulator base which provides electrical connection between the first and second clamp areas 16 and 17 at least when the screws are tightened.

Also, the second conductor aperture 15 on what might be called the top 41 of the conductor block 12 is small enough, and the clamp area is recessed sufficiently from the exterior surface so that the respective clamp area cannot be touched by an adult human's fingertip. This conductor aperture 15 in its largest dimension may be only about ¼ of an inch in length. With this smaller dimension, a person's fingertip cannot reach inside this conductor aperture sufficiently to engage any energizable, electrical conductor, such as the conductor 37, the cage 30 or the clamp bar 40. This second conductor aperture leading to the second clamp area 17 may be one used by a consumer who wishes to make connection to a terminal block and through it to a transformer coil, for example. The first clamp area 16 is similarly recessed from the exterior surface sufficiently that an adult human's fingertip may not engage any electrical energizable conductor. Since this first conductor aperture is intended for use at the manufacturing plant for connection to an adjacent electrical coil, for example, and the physical presence of the coil may help to prevent any exposed electrical conductors, this respective clamp area 16 may not be as deeply recessed as the second clamp area 17.

The terminal block 11 has a support surface 46 near the bottom of the block opposite the top 41. This support surface is adapted to be that which supports the terminal block 11 on a mount 47. This mount may be an insulator, although it is a conductor, as shown in FIG. 1. The mount has upper and lower surfaces 48 and 49 with the upper surface adapted to receive the terminal block support surface 46. A cantilever arm 50 extends from the bottom of the terminal block and is adapted to engage the lower surface 49 of the mount 47. This secures the terminal block 11 in vertical directions. The end of the cantilever arm has a hook 51 which is adapted to hook onto a locking surface 52 of the mount 47. An abutment surface is at the proximal end of the cantilever arm 50, to secure the terminal block 11 on the mount in all directions.

The construction of this terminal block 11 makes it what is termed in the trade as a finger-safe terminal wherein there are no electrically conductive parts which may be touched by an adult human's fingertip, and thus, the terminal block is quite safe for consumers of the electrical product on which this terminal block may be mounted.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A finger-safe terminal block including:

an insulator base having an exterior surface including a support surface to support said terminal block on a mount;

a cantilever arm on said base adapted to engage an opposite surface of the mount for the terminal block;

first and second screw apertures in the exterior surface of said insulator base;

first and second rotatable screws in said first and second screw apertures, respectively, leading to first and second clamp areas, respectively, of said insulator base;

first and second conductor apertures in said insulator base adapted to receive first and second external conductors therein, respectively;

said first and second conductor apertures leading from the exterior surface to said first and second clamp areas, respectively, of said base;

each screw having a tool access end accessible from the exterior surface of the base, wherein tightening of each screw is adapted to physically clamp an end of an external conductor in the respective clamp area;

said first and second screw apertures at the base exterior surface being sufficiently small and each screw being mounted in a respective screw aperture with the tool access end recessed from the base exterior surface sufficiently that it cannot be touched by an adult human's finger tip; and a conductor in said insulator base to provide electrical connection between said first and second clamp areas at least when the screws are tightened.

2. A terminal block as set forth in claim 1, including said second conductor aperture being sufficiently small that the respective clamp area cannot be touched by an adult human's fingertip.

3. A terminal block as set forth in claim 1, including said first and second clamp areas being recessed from the exterior surface and the conductor apertures being sufficiently small that the respective clamp areas cannot be touched by an adult human's fingertip.

4. A terminal block as set forth in claim 1, including a hook on an end of said cantilever arm adapted to engage a locking surface of the mount.

5. A terminal block as set forth in claim 1, wherein said screws are captive.

6. A terminal block as set forth in claim 1, wherein said screws are rotatable and captive in a manner to be axially immovable so that they cannot be unscrewed to a position so near to the exterior surface so as to be touched by an adult human's fingertip.

7. A terminal block as set forth in claim 1, including a metal cage movable by rotation of a screw to clamp an external conductor in the respective clamp area.

8. A terminal block as set forth in claim 7, including separate cages for each screw to separately clamp an external conductor in the respective clamp area.

9. A terminal block as set forth in claim 1, wherein the first and second screw apertures are disposed at an angle to each other.

10. A terminal block as set forth in claim 1, wherein the first and second screw apertures are disposed at substantially right angles to each other.

11. A terminal block as set forth in claim 1, wherein said conductor apertures are disposed at substantially right angles to each other.

12. A terminal block as set forth in claim 11, wherein said first screw aperture and said second conductor aperture are disposed substantially parallel to each other.

* * * * *